United States Patent [19]

Farrar

[11] Patent Number: 4,864,954

[45] Date of Patent: Sep. 12, 1989

[54] SAIL FOR A SAILING CRAFT

[76] Inventor: Austin P. Farrar, Orchard House, Stutton, Ipswich, Suffolk, IP9 2RY, United Kingdom

[21] Appl. No.: 255,037

[22] Filed: Oct. 7, 1988

[30] Foreign Application Priority Data

Oct. 31, 1987 [GB] United Kingdom ..... 8725570

[51] Int. Cl.[4] ..... B63H 9/04

[52] U.S. Cl. ..... 114/103

[58] Field of Search ..... 114/102, 103, 39.1, 114/39.2

[56] References Cited

U.S. PATENT DOCUMENTS

| | | | |
|---|---|---|---|
| 2,971,488 | 2/1961 | Morissette | 114/103 |
| 3,053,219 | 9/1962 | Coon | 114/103 |
| 4,269,133 | 5/1981 | Brown | 114/103 |
| 4,646,670 | 3/1987 | Jamieson | 114/102 |
| 4,653,416 | 3/1987 | Debarge . | |

FOREIGN PATENT DOCUMENTS

| | | | |
|---|---|---|---|
| 3232976 | 3/1984 | Fed. Rep. of Germany | 114/103 |
| 3405546 | 8/1985 | Fed. Rep. of Germany . | |
| 3434547 | 3/1986 | Fed. Rep. of Germany . | |
| 2481225 | 10/1981 | France . | |
| 2537085 | 6/1984 | France . | |
| 2543509 | 10/1984 | France . | |
| 2550511 | 2/1985 | France | 114/102 |
| 2592359 | 7/1987 | France | 114/39.2 |
| 7906386 | 2/1981 | Netherlands | 114/103 |
| 8303872 | 6/1985 | Netherlands | 114/103 |
| 0110896 | 12/1983 | PCT Int'l Appl. . | |

OTHER PUBLICATIONS

Multihull International pamphlet, entitled "Composite Wingmasts", by Nick Barlow, dated Sep., 1987. Shows in FIG. 2 on page 231 a multi-slotted C class wing.

*Primary Examiner*—Sherman D. Basinger
*Assistant Examiner*—Stephen P. Avila
*Attorney, Agent, or Firm*—Rogers, Howell & Haferkamp

[57] ABSTRACT

A sail particularly suited for use with sailboards engaged in speed sailing made of sailcloth or other sailmaking material has a cut away area forming a vertical slot between the luff and the leech of the sail. This ensures that laminar flow is produced not only at the leading edge of the sail but also at the trailing edge adjacent the leech.

7 Claims, 1 Drawing Sheet

SAIL FOR A SAILING CRAFT

This invention relates to a sail for a sailing craft, and particularly but not exclusively to a sail for sailboard.

The invention is concerned with "soft" sails made of a flexible sailmaking material, as opposed to rigid or "wing" sails.

In order to achieve the high sailing speeds currently obtainable with sailboards, a very considerable degree of camber is necessary in the forward part of the sail. The result of this excessive camber is that the after part of the sail, close to the leech, is stalled.

According to the present invention there is provided a sail for a sailing craft, the sail having a luff and a leech and a cut away area extending in the direction of the height of the sail between the luff and the leech.

The presence of this cut away area or slot allows air to pass from the windward side to the leeward side of the sail, so as to reattach the air flow in the region of the leech so that laminar, non-stalled flow takes place in this area.

Preferably the slot will extend substantially the whole height of the sail and will be bridged by sail battens. The sail battens may be those conventionally present in a fully-battened sail.

The width of the slot may be equal to one third the width of the sail at any point, and may be positioned mid way between the luff and the leech.

The leading edge of the slot (which effectively forms a leech to the forward part of the sail) is preferably straight. The after edge of the slot (which effectively forms a luff to the after part of the sail) may be straight or curved, with the curved form being proposed to ensure that this "luff" is held taut.

The invention also provides a sail for a sailboard, which sail is adapted to be set on a wishbone rig, has a mast pocket at the luff and a plurality of battens extending substantially the full width of the sail from the mast pocket to the leech, wherein part of the material of the sail between the luff and the leech is cut away, this cut away part being traversed by the sail battens.

The sail may be made of any conventional woven or non woven material used for sail making.

The invention will now be further described, by way of example, with reference to the accompanying drawing, in which.

Figure 1:
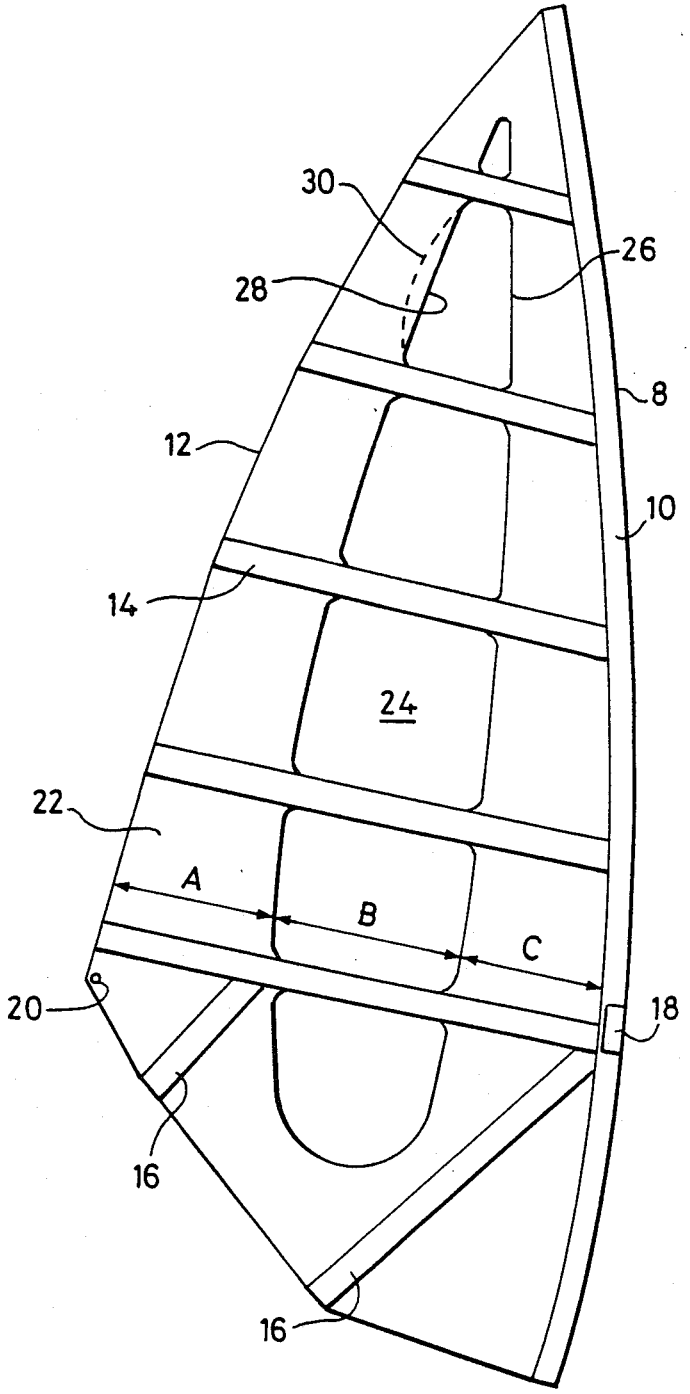
FIG. 1 is an elevation of a sailboard sail in with the invention.

The sail shown in FIG. 1 has a luff with a mast pocket 10, a leech 12 and five horizontal battens 14. There are also one or two angled battens 16 to support the foot area of the sail. A cut out 18 allows the forward end of the wishbone boom to be attached to the mast, and a clew 20 is provided to attach the sail to the after end of the boom.

The material 22 of the sail is conventional and may for example be ny Terylene, Dacron, Mylar or Kevlar fabric (all these names are Registered Trade Marks), all of which are regularly used in sail manufacture.

Between the luff 8 and the leech 12, a central region of the sail material 22 is cut away to form a vertically extending slot 24. This slot extends substantially the whole height of the sail from the foot to the head and is bridged by the horizontal battens 14. The slot 24 is stopped below the head and above the foot to leave sufficient material to support the sail.

The ratio of the distances A:B:C can conveniently be 1:1:1, but alterations to these ratios are quite possible.

The leading edge 26 of the slot 24 is generally straight, but is blended into the batten pockets adjacent each batten 14 in order to spread the stresses in these areas and to prevent tearing.

The after edge 28 of the slot is shown also straight, but an alternative construction may take a curved or arcuate form as shown in dotted lines at 30 in FIG. 1.

Figure 2:
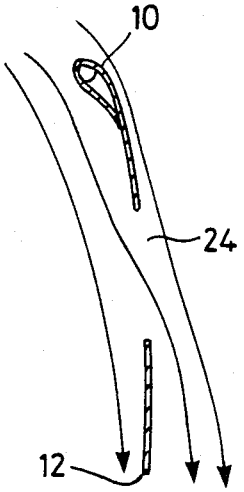
FIG. 2 is a horizontal section through the sail showing the aerodynamic flow across it.

FIG. 2 shows schematically the air flow across this sail. It will be seen that some of the air which passes over the windward side of the leading part of the sail then passes through the slot and subsequently passes over the leeward part of the after section of the sail. This air which crosses from one side of the sail to the other in this way will be more likely to produce laminar flow on the leeward side of the after part of the sail than would be the case with the air which has had to travel around the highly cambered forward part of the sail, on the leeward side thereof.

The benefit of this sail design is expected to be most pronounced on craft which sail with highly cambered sails, in particular sailboards engaged in speed sailing. However the invention is not restricted to this application and may be used in other types of sailing craft.

I claim:

1. A sail for a sailing craft, the sail being made of a woven or non-woven flexible material, having a primary luff and primary leech defined by the perimeter of the sail and a cut away area extending substantially the whole height of the sail between the primary luff and the primary leech to divide the sail into leading and trailing sail sections with the sail material at the forward edge of the cut away area forming a leech for the leading sail section and the material at the after edge of the cut away area forming a luff for the trailing sail section.

2. A sail as claimed in claim 1, wherein the cut away area is bridged by sail battens.

3. A sail as claimed in claim 1, wherein the cut away area has a width equal to approximately one-third the width of the sail at any point.

4. A sail as claimed in claim 1, wherein the cut away area is positioned midway between the primary luff and the primary leech.

5. A sail as claimed in claim 1, wherein the leading edge of a cut away area is straight.

6. A sail as claimed in claim 1, wherein the after edge of the cut away area is curved.

7. A sail as claimed in claim 1 for use on a sailboard and adapted to be set on a wishbone rig, the sail having a mast pocket at the luff and a plurality of battens extending substantially the full width of the sail from the mast pocket to the primary leech.

* * * * *